US005261803A

United States Patent [19]

Freeman

[11] Patent Number: 5,261,803

[45] Date of Patent: Nov. 16, 1993

[54] GEROTOR PUMP WITH INTERFERENCE FIT CLOSURE

[75] Inventor: Richard R. Freeman, Ardens Grafton, Great Britain

[73] Assignee: Concentric Pumps Limited, Great Britain

[21] Appl. No.: 698,959

[22] Filed: May 13, 1991

[30] Foreign Application Priority Data

May 12, 1990 [GB] United Kingdom ..... 9010684
Jun. 1, 1990 [GB] United Kingdom ..... 9012295

[51] Int. Cl.[5] ..... F04C 2/10; B23P 11/02
[52] U.S. Cl. ..... 418/171; 29/525; 29/888.023
[58] Field of Search ..... 418/171, 170, 168, 167, 418/166, 169; 29/525

[56] References Cited

U.S. PATENT DOCUMENTS

| | | | |
|---|---|---|---|
| 2,905,094 | 9/1959 | Gerteis | 418/169 |
| 3,130,680 | 4/1964 | Johnson | 418/171 |
| 4,185,717 | 1/1980 | Ford, Jr. et al. | 418/171 |
| 4,496,297 | 1/1985 | Ogawa | 418/270 |
| 4,540,347 | 9/1985 | Child | 418/171 |
| 4,592,706 | 6/1986 | Matsuo et al. | 418/171 |
| 4,760,752 | 8/1988 | Wield et al. | 403/383 |

FOREIGN PATENT DOCUMENTS

| | | | |
|---|---|---|---|
| 62-20682 | 1/1987 | Japan | 418/171 |

*Primary Examiner*—John J. Vrablik
*Attorney, Agent, or Firm*—Learman & McCulloch

[57] ABSTRACT

A method of setting up the required running tolerances in a gerotor pump having annulus and rotor meshed together and located in a body comprises pressing a cover plate (FIG. 1) or equivalent as an interference fit into the body and then allowing it to relax and recover elastically to set up the required tolerances at axial ends of the gerotor set.

19 Claims, 2 Drawing Sheets

GEROTOR PUMP WITH INTERFERENCE FIT CLOSURE

Figure 1:
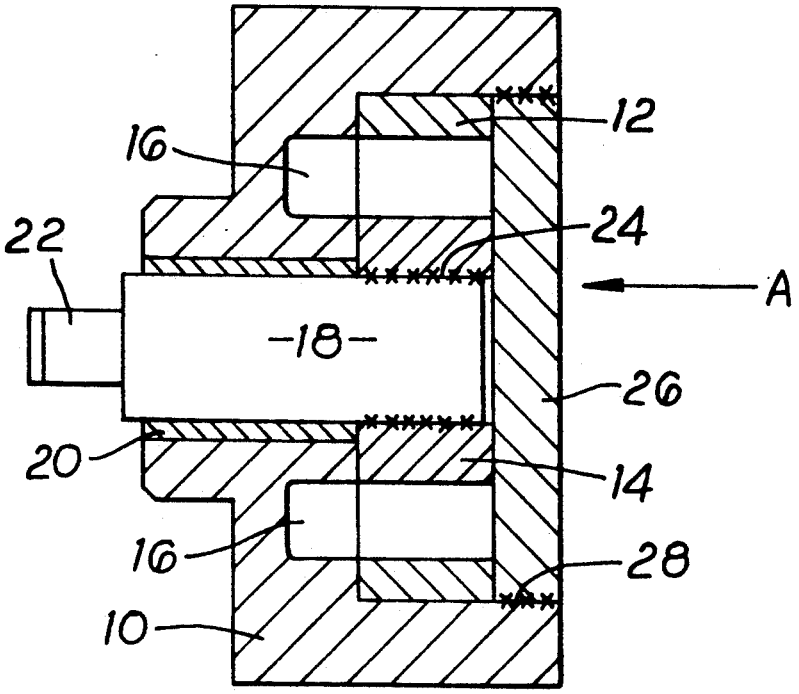

This invention relates to gerotor pumps, which have a male lobed rotor with n teeth located in a female lobed rotor with n+1 teeth so as to provide a set of pumping chambers between the lobes. The rotors and chambers rotate and in so doing the chambers increase and decrease in size to perform induction and ejection of pumped fluid.

The chambers are each bounded in the circumferential direction by two lines of contact between rotor and annulus. At axial ends the chambers are bounded by the pump body, which most usually includes a cylindrical cavity housing the gerotor set, so that the base of the cavity provides one axial end wall for the chambers, and a cover plate for the body provides the opposite end wall.

Pumping efficiency depends primarily upon chamber sealing, and one of the most critical areas available for control is that of axial clearance between the parts.

The manufacturing methods used for the gerotor set frequently involve compaction and sintering of powdered metals for reasons which will be understood by the production engineer, and this is followed by machining of the axial faces of the gerotor parts in order to provide the required smoothness of finish to those end faces which are to rub on the body and cover plate.

There is a dilemma for the pump manufacturer in that particularly narrow manufacturing tolerances are needed for the body cavity axial length and for the gerotor parts axial length in order to achieve high efficiency. This is done, in conventional production engineering, by setting acceptable standards, gauging all components and rejecting those outside the preset limits. This is inevitably expensive because of the unavoidable rejection rate, and particularly so with powdered metal compacts which sometimes require to be machined more or less because of variations in the material.

The object of the present invention is to enable narrow assembled tolerances to be achieved in a less expensive way.

According to the invention the pump body cavity is closed by a part which is axially fixed in position by being an interference fit with another pump component, and the axial location of said part and hence the internal running tolerance is arrived at by displacing said part relative to said other component under a predetermined load until all clearances are removed, and then allowing the natural elastic recovery of the parts to establish a required internal running tolerance.

Various possibilities are within the scope of the invention including those of using a stationary shaft, or of using a rotatable shaft, for the gerotor set. Where there is a stationary shaft, the cover plate can be an interference fit with the shaft for the purposes of the invention, but where there is a rotatable shaft which is to transmit drive, the axial tolerance control member may be fixed relative to the pump body rather than the shaft.

Four embodiments of the invention are now more particularly described with reference to the accompanying drawings wherein each of the figures is a sectional elevation of a different one of the four.

Turning now first to FIG. 1, the pump body 10 has a cylindrical cavity journalling the annulus 12 which is meshed with the rotor 14. The body is formed with inlet and outlet ports 16 opening to the chambers defined between the gerotor parts 12, 14.

In this instance, a drive shaft 18 is employed which is journalled in a bush 20 and driven for example by means of a tang 22 on the shaft. The shaft is an interference fit with the rotor at 24.

Cover plate 26 is employed, and the axial tolerance between the gerotor parts and the body and cover plate is determined by pressing the cover plate in the direction of arrow A into the body in which it is an interference fit at 28, under a predetermined load, thereby conjointly displacing the cover plate and the gerotor set toward the cavity base to take up all axial clearance between the cover plate, the cavity base, and the gerotor set, and then allowing the cover plate to recover elastically, so as to set up the internal tolerances. It will be appreciated that with this design, the gerotor set can vary in axial dimension quite substantially but a standard tolerance can be set up.

Figure 2:
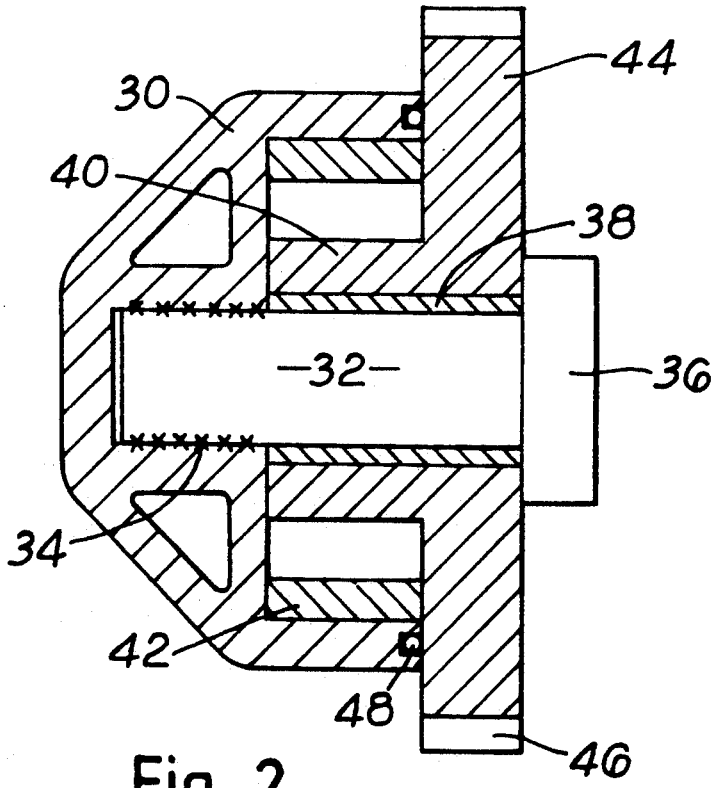

In the arrangement in FIG. 2 the shaft 32 is an interference fit at 34 in a cavity in the body 30. In this instance the shaft has a head 36. Bush 36 journals the rotor 40 which is meshed with the annulus 42. Rotor 40 is integral with a radial flange 44 which forms both a cover plate and a drive transmission device for example by provision of gear teeth 46 at its periphery. Again it will be appreciated that axial running clearances are provided by pressing the head 36 to drive the shaft further into the body under the predetermined load and then relaxing it. A seal member may be provided peripherally at 48 between the rotatable component 44 and the stationary body 30: no bearing is necessary at that point because of the running tolerance/clearance.

Figure 3:
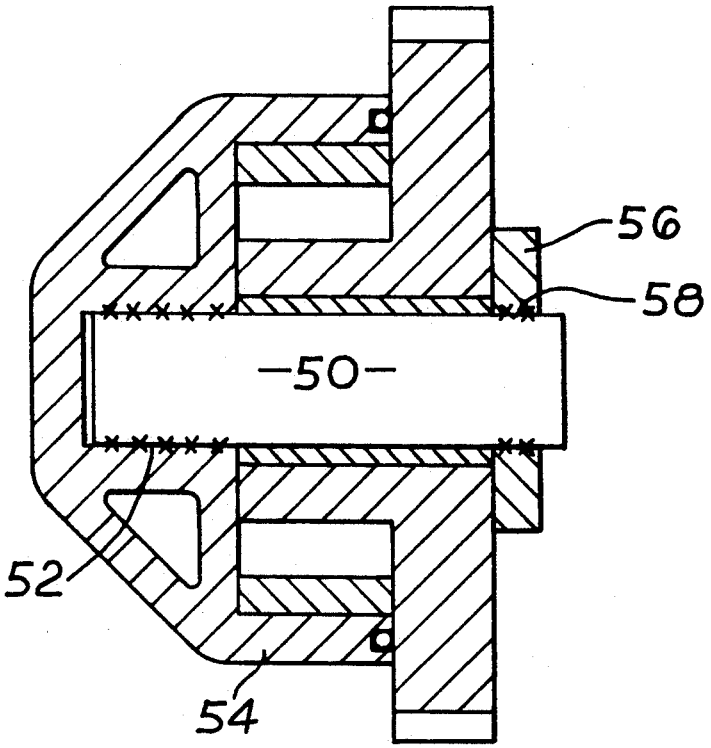

FIG. 3 can be considered as a version of FIG. 2 in which shaft 50 is first pressed into interference fit at 52 into the body 54, and then, instead of using a head on the shaft, a separate location component 56 which is an interference fit at 58 is pressed onto the projecting end of the shaft 50 to set up the required running tolerances in the same way as previously described.

Figure 4:
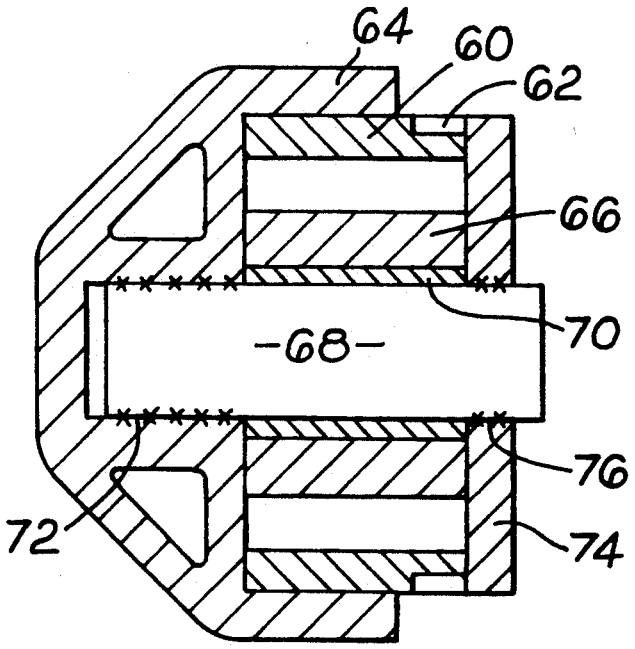

In FIG. 4 the annulus 60 is driven by means of gear teeth 62 provided at an axial outer end of the annulus, the axially inner end of the same being journalled in the body as before. Male rotor 66 is meshed with the annulus and runs on shaft 68 with an interposed bush 70. Shaft 68 is an interference fit at 72 in the body, and cover plate 74 is an interference fit at 76 with the same shaft 68. Again, running tolerances are set up in the same way.

All of the illustrated versions use journal bushes at one point or another for rotary components, but the presence or absence of these journal bushes depends upon the nature of the materials employed and in some cases components may be journalled directly on the shaft or directly in the body as the case may be.

I claim:

1. In a pump comprising a body having therein a cavity terminating at one end in a base, a gerotor set annulus and rotor located in the cavity, and a closure carried by said body and closing said cavity at its opposite end, the base of the cavity and said closure being spaced axially by a distance equal to the axial length of the gerotor set plus a required internal running tolerance, the improvement wherein said closure is axially positioned solely by means of an interference fit with another pump component, the final axial position of said closure and hence the internal running tolerance being arrived at by conjointly displacing said closure and said gerotor set relative to said other component under a predetermined load in a direction toward said base until all axial clearances between said gerotor set and said base of the cavity and between said gerotor set and said closure are removed, and then allowing the natural elastic recovery of said gerotor set, said body, said closure, and said pump component to establish said required internal running tolerance for said gerotor set as permitted by said interference fit.

2. A pump as claimed in claim 1 wherein said closure is a cover plate and said another pump component is said pump body, said cover plate being disposed in said cavity in an axial position that is determined by the axial length of the gerotor set.

3. A pump as claimed in claim 1 wherein said closure closing the cavity is a stationary part which is angularly fixed relative to the pump body.

4. A pump as claimed in claim 1 wherein the said closure closing the cavity is axially fixed but rotatably free.

5. A pump as claimed in claim 1 wherein the said closure closing the cavity is a driven member for the gerotor set.

6. A pump as claimed in claim 1 wherein the said closure closing the cavity is a cover plate.

7. In a gerotor pump comprising a body having a cavity therein closed at one side by a base, a lobed gerotor set annulus and rotor forming pumping chambers and accommodated in the cavity for rotation about respective axes extending through said cavity, said base closing one side of said chambers, and a closure closing the opposite side of said chambers, the base of the cavity and said closure being spaced longitudinally of said axes by a distance equal to the axial length of the gerotor set plus a required internal running tolerance, the improvement wherein said closure is axially positioned by means of an interference fit with another pump component, and the axial position of said closure and hence the internal running tolerance is arrived at by conjointly displacing said closure and said gerotor set relative to said another component under a predetermined load until all axial clearance between said gerotor set and said base and between said gerotor set and said closure is removed, and then allowing the natural elastic recovery of the gerotor set, said base, said closure, and said component to establish the required internal running tolerance by relative axial movement of said closure and said another pump component as permitted by said interference fit.

8. A pump as claimed in claim 7 wherein said closure is a cover plate that can be accommodated in various axial positions within said cavity.

9. A pump as claimed in claim 7 wherein said closure is stationary and angularly fixed relative to the pump body.

10. A pump as claimed in claim 7 wherein said closure is rotatable about said axis.

11. A pump as claimed in claim 10 wherein said closure includes drive means for the gerotor set.

12. A pump as claimed in claim 10 including seal means between said closure and said body.

13. A pump as claimed in claim 7 including a shaft extending into said cavity, said shaft having an interference fit with said rotor, and means journalling said shaft for rotation in said body.

14. A pump as claimed in claim 7 including a shaft extending into said cavity, said shaft having an interference fit with said body, and means journalling said closure on said shaft.

15. A pump as claimed in claim 14 including a location member seated on said closure and having an interference fit with said shaft.

16. A pump as claimed in claim 14 including drive teeth on said closure.

17. A method of assembling a gerotor pump having a gerotor set comprising a lobed rotor within a lobed annulus having pumping chambers between the lobes, said method comprising mounting said gerotor set on a shaft member accommodated in a cavity in a pump body member and forming an axis of rotation, said cavity having a base closing one side of said chambers; applying to one of said members with an interference fit a closure in a position to engage said gerotor set and close the opposite side of said chambers; compressing said gerotor set between said base and said closure under a predetermined load sufficient to remove all axial clearance between said gerotor set and said base and between said gerotor set and said closure; and relaxing said load to enable natural elastic recovery of the compressed parts to establish the required internal running tolerance between said gerotor set, said cavity base, and said closure by relative axial movement of said members as permitted by said interference fit.

18. A method as claimed in claim 17 wherein said closure is applied to said pump body member.

19. A method as claimed in claim 17 wherein said closure is applied to said shaft member.

* * * * *